US006516788B1

(12) United States Patent
Roderique

(10) Patent No.: US 6,516,788 B1
(45) **Date of Patent: *Feb. 11, 2003**

(54) GEAR DRIVEN SUPERCHARGER HAVING NOISE REDUCING IMPELLER SHAFT

(75) Inventor: Glennon J. Roderique, Lenexa, KS (US)

(73) Assignee: Accessible Technologies, Inc., Lenexa, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/064,564

(22) Filed: Jul. 26, 2002

Related U.S. Application Data

(63) Continuation of application No. 09/669,018, filed on Sep. 22, 2000.

(51) Int. Cl.[7] ..... F02B 33/00
(52) U.S. Cl. ..... 123/559.1
(58) Field of Search ..... 123/559.1, 565; 148/321; 415/124.2, 205, 199.1, 122.1

(56) References Cited

U.S. PATENT DOCUMENTS 6,129,510 A * 10/2000 Martin ..... 123/559.1
6,258,180 B1 * 7/2001 Wilde et al. ..... 148/321

FOREIGN PATENT DOCUMENTS

| | | | |
|---|---|---|---|
| JP | 27 52 405 A | * | 5/1979 |
| JP | 02107721 A | * | 4/1990 |
| JP | 405093225 A | * | 4/1993 |
| JP | 408170714 A | * | 7/1996 |
| JP | 409068261 A | * | 3/1997 |
| JP | 411061268 A | * | 3/1999 |
| JP | 02000239780 A | * | 9/2000 |
| JP | 02000346177 A | * | 12/2000 |
| JP | 02001124180 A | * | 5/2001 |

* cited by examiner

*Primary Examiner*—Thomas Denion
*Assistant Examiner*—Thai-Ba Trieu
(74) *Attorney, Agent, or Firm*—Hovey Williams LLP

(57) ABSTRACT

A centrifugal supercharger includes a gear-type transmission for drivingly connecting the impeller to the engine. The transmission includes an impeller shaft supporting the impeller and being fixed relative to one of the gears of the transmission. The preferred impeller shaft and gear fixed thereto are integrally formed of cast iron so as to dampen propagation of sound waves to the impeller, thereby reducing the amplification of transmission noise by the impeller. Depending upon the desired horsepower gains provided by the supercharger, the impeller shaft preferably has a minimum shaft diameter.

28 Claims, 3 Drawing Sheets

GEAR DRIVEN SUPERCHARGER HAVING NOISE REDUCING IMPELLER SHAFT

CROSS REFERENCE TO RELATED APPLICATIONS

This application is a continuation of application Ser. No. 09/669,018, filed Sep. 22, 2000, which is hereby incorporated by reference herein.

BACKGROUND OF INVENTION

1. Field of the Invention

The present invention relates generally to centrifugal superchargers for providing increased airflow to an engine. More particularly, the present invention concerns a gear driven supercharger provided with an impeller shaft that dampens noise created by the transmission and thereby prevents the noise from being amplified by the impeller.

2. Discussion of Prior Art

A centrifugal supercharger traditionally has a transmission that drivingly connects the impeller to the power source (e.g., a belt drive of the engine). Although supercharger transmissions have been variously constructed, gear-type transmissions are most preferred because of their high load capacities and durability.

However, superchargers using a gear drive are often considered loud as compared to, for example, a supercharger using a belt drive. Those ordinarily skilled in the art will appreciate that the noise (typically a high-pitched shrill) generated by a gear driven supercharger is, in some conditions, greater than that generated by the engine. In fact, this problem is often one of the most common customer complaints associated with gear driven centrifugal superchargers.

SUMMARY OF THE INVENTION

Responsive to these and other problems, an important object of the present invention is to provide a supercharger that is capable of providing the desired horsepower increases. It is also an important object of the present invention to provide a supercharger that has the same durability and high load capacity as conventional superchargers but generates relatively less noise. In this regard, an important object of the present invention is to provide a low-noise supercharger that is capable of generating the desired horsepower increases. Yet another important object of the present invention is to provide a supercharger having a simple and inexpensive construction.

In accordance with these and other objects evident from the following description of the preferred embodiments, the present invention concerns a supercharger including a gear-type transmission having an impeller shaft that supports the impeller. The impeller shaft is fixed relative to one of the gears of the transmission, with at least a portion of either or both the shaft and the one gear being formed of cast iron. Such a construction causes dampening of sound waves propagating to the impeller, and amplification of transmission noise by the impeller is consequently reduced. The impeller shaft preferably has a minimum diameter that varies depending upon the desired horsepower gain provided by the supercharger.

Other aspects and advantages of the present invention will be apparent from the following detailed description of the preferred embodiment and the accompanying drawing figures.

BRIEF DESCRIPTION OF THE DRAWINGS

A preferred embodiment of the invention is described in detail below with reference to the attached drawing figures, wherein.

DETAILED DESCRIPTION

Figure 1:
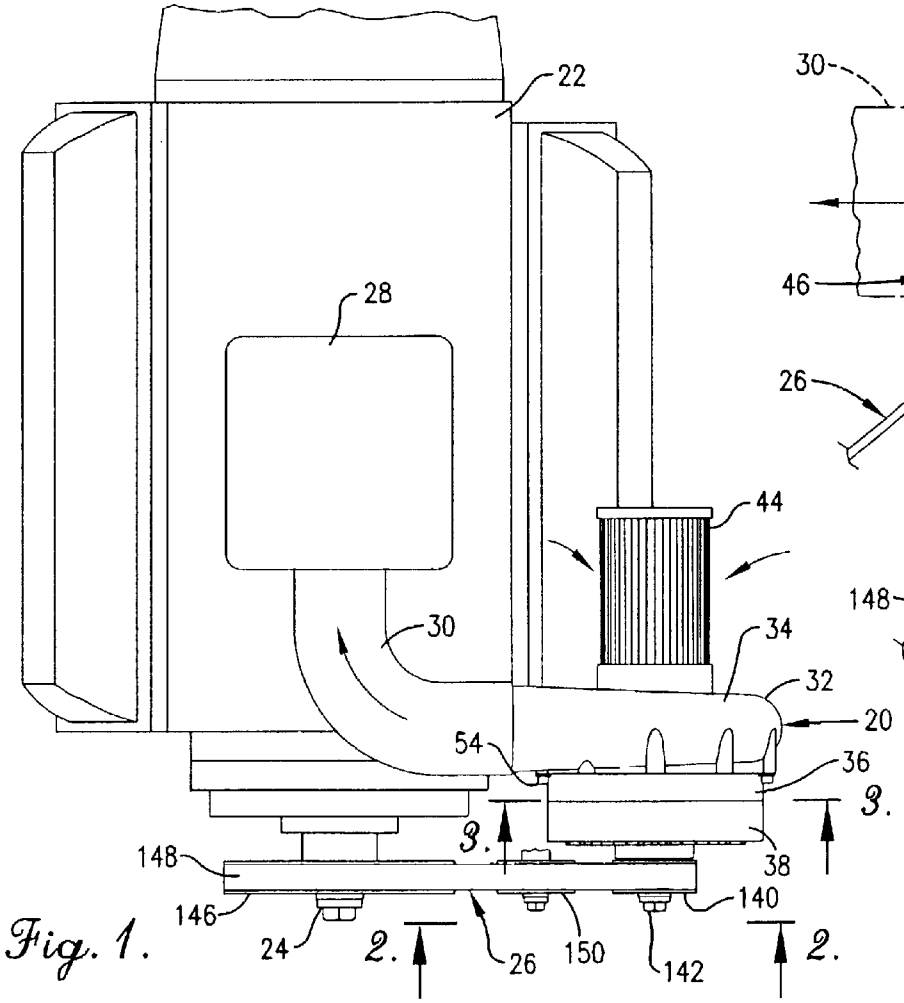
FIG. 1 is a fragmentary, partially schematic plan view of an internal combustion engine including a centrifugal supercharger constructed in accordance with the principles of the present invention.

Turning initially to FIG. 1, the supercharger 20 selected for illustration is shown in use with an internal combustion engine 22 of a vehicle such as a boat or automobile. Although the illustrated engine 22 has eight cylinders, the principles of the present invention are equally applicable to various other types of engines. It is noted, however, that the supercharger 20 is preferably driven directly by the engine 22, with the crankshaft 24 and a belt drive 26 providing driving power to the supercharger 20. Moreover, the supercharger 20 is connected to the engine intake 28 (e.g., an intake plenum box) by a conduit 30, such that pressurized air generated by the supercharger 20 is directed to the intake 28. Again, the principles of the present invention are not limited to the illustrated application, but rather the inventive supercharger 20 may be associated with any system in which a highly pressurized air stream is desired. For example, it is entirely within the ambient of the present invention to utilize the supercharger 20 in various other types of reciprocating engines.

The illustrated supercharger 20 includes a case 32 that defines compressor and transmission chambers as identified hereinbelow. As perhaps best shown in FIG. 4, the preferred case 32 generally includes three main sections 34,36,38 that are formed of any suitable material (e.g., polished cast steel) and interconnected as will be described.

The case sections 34 and 36 cooperate to define a compressor chamber 40 in which incoming fluid (e.g., air, air/fuel mixture, etc.) is pressurized and accelerated. The case section 34 presents a central inlet opening 42 (see FIG. 4) through which fluid enters the chamber 40. A filter 44 (see FIG. 1) is preferably provided at the inlet opening 42, as shown, or somewhere upstream from the opening 42. Although not illustrated, the inlet opening 42 may alternatively communicate with a forwardly open conduit (not shown) that extends toward the front of the powered vehicle, such that air flow to the supercharger 20 is facilitated when the vehicle is moving in a forward direction. The case section 34 is configured in such a manner that a portion 40*a* of the compressor chamber 40 extends circumferentially around the inlet opening 42 to form a volute of progressively increasing diameter. The volute portion 40*a* of the compressor chamber 40 terminates at a tangential outlet opening 46 (see FIGS. 2 and 3), with the latter communicating with the engine intake 28 via conduit 30 (see also FIG. 1). In this regard, fluid entering the illustrated compressor chamber 40 flows axially through the inlet opening 42, is propelled generally radially into the volute portion 40*a*, and then directed along a generally circular path to the outlet opening 46.

Figure 4:
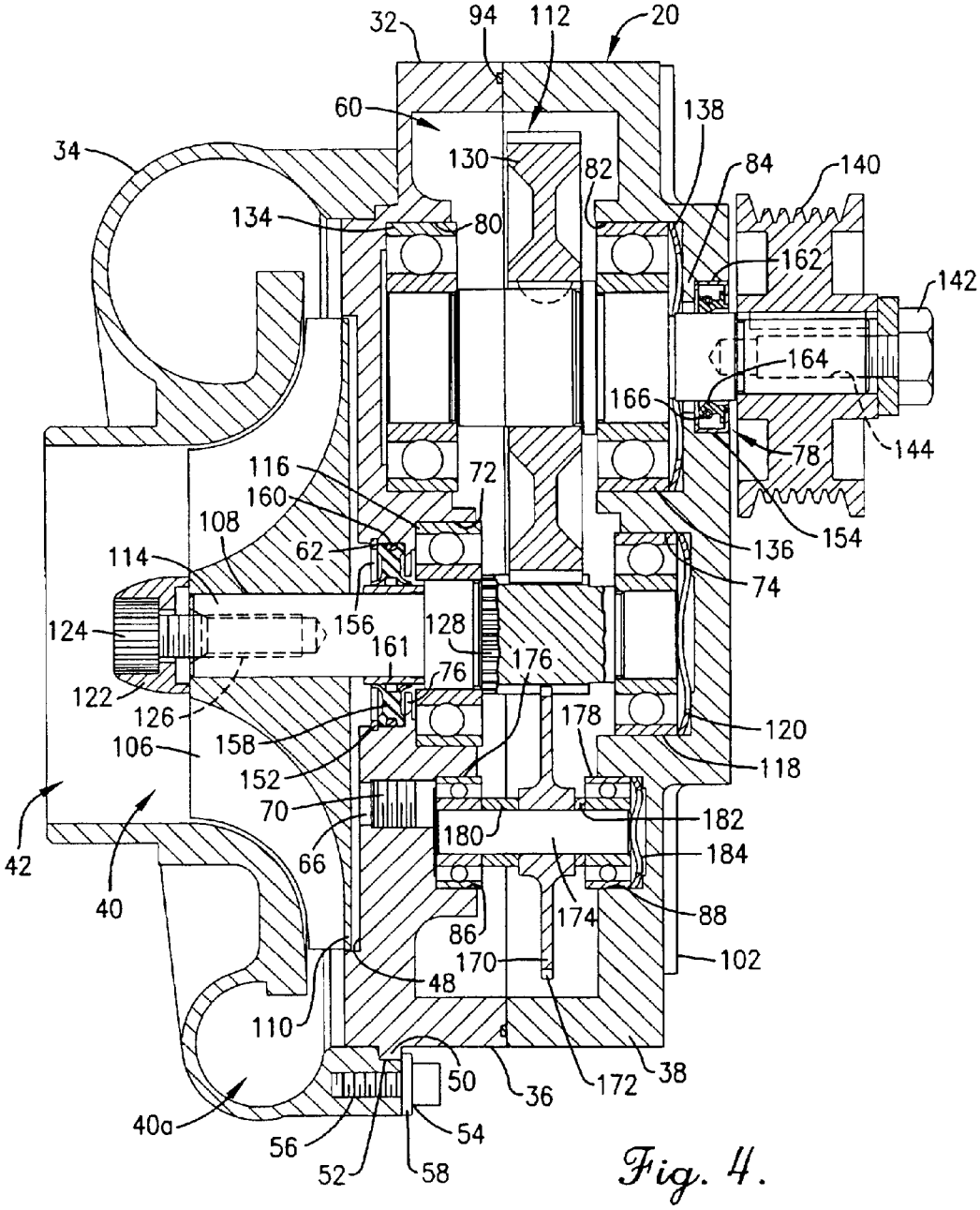
FIG. 4 is an even further enlarge cross-sectional view of the supercharger taken generally along line 4—4 of FIG. 3, particularly illustrating the impeller shaft forming part of the gear transmission and supporting the impeller.

As shown in FIG. 4, the case section 36 presents a circular recess 48 for purposes which will be described. In addition, the section 36 presents an outwardly projecting lip 50 that extends partly around the perimeter thereof (e.g., see FIGS. 2 and 4 ). The lip 50 is received in a complemental groove 52 defined in the case section 34, and a plurality of fastener assemblies 54 serve to secure the case sections 34 and 36 to one another. As particularly shown in FIG. 4, each of the fastener assemblies 54 preferably includes a threaded screw 56 received in the case section 34 and a washer 58 pressed against the lip 50.

Figure 3:
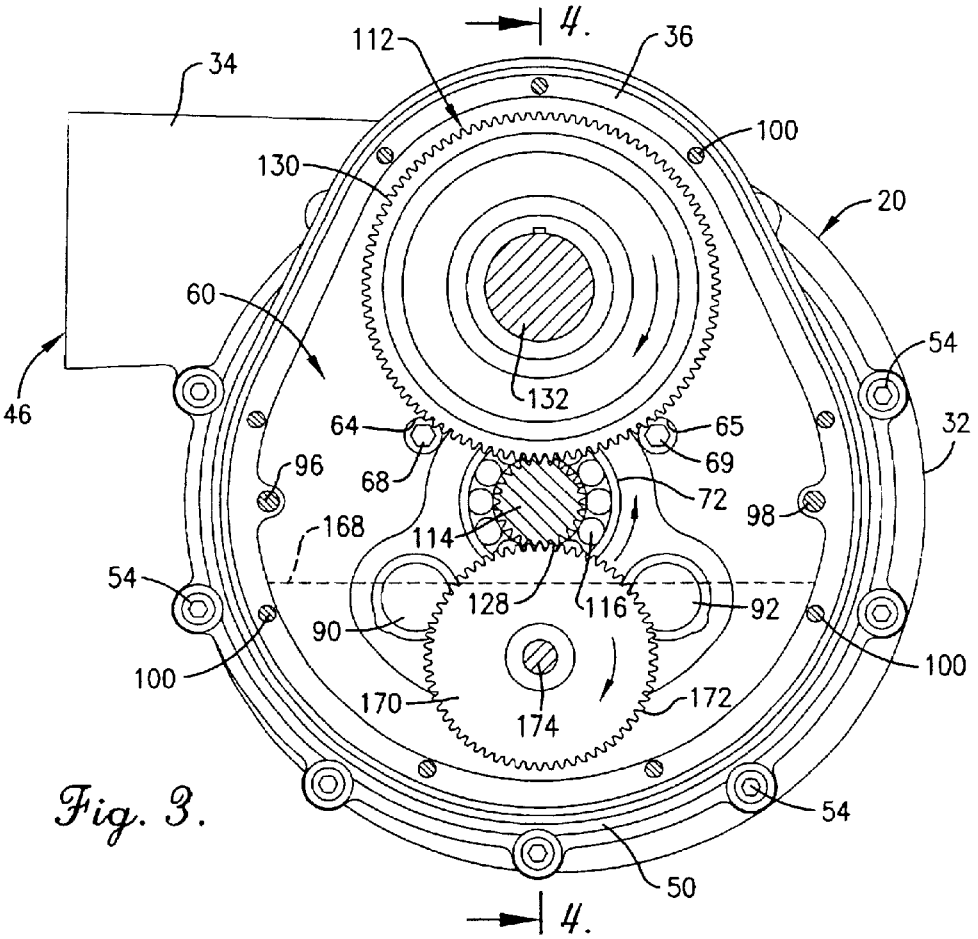
FIG. 3 is an enlarge cross-sectional view of the supercharge taken generally along line 3—3 of FIG. 1. particularly illustrating the transmission chamber and the components located therein.

The middle case section 36 also cooperates with the case section 38 to define a transmission chamber 60 (see FIGS. 3 and 4). As particularly shown in FIG. 3, the transmission chamber 60 is preferably teardrop shaped, with the bottom being wider than the top. An impeller shaft opening 62 that is concentric with the inlet opening 42 extends through the case section 36 from the compressor chamber 40 to the transmission chamber 60. A set of internally threaded passageways 64,65,66 also extend through the case section 36, with each of the passageways 64,65,66 normally being sealed by a respective threaded plug 68,69,70. Except for the shaft opening 62 and the passageways 64,65,66, the chambers 40 and 60 are otherwise separated from one another by the case section 36. Defined in the case sections 36 and 38 in axial alignment with the shaft opening 62 are a pair of opposed bearing assembly sockets 72 and 74. An inwardly projecting dividing wall 76 is located along the shaft opening 62 to present a seal recess for purposes which will be described.

The case section 38 similarly includes an input shaft opening 78 that is spaced upwardly from the bearing assembly socket 74. Similar to the impeller shaft opening 62, the input shaft opening 78 is axially aligned with opposed bearing assembly sockets 80 and 82 defined in the case sections 36 and 38. There is likewise an inwardly projecting dividing wall 84 alongside the bearing assembly socket 82 to present a seal recess as will be described. In the preferred embodiment, a pair of opposed, relatively small bearing assembly sockets 86 and 88 defined in the case sections 36 and 38 are utilized, although two additional pairs of sockets 90 and 92 (only the sockets defined in the case section 36 being shown in FIG. 3) are provided in the transmission chamber 60. As will be described, the three pairs of sockets permit the supercharger to be mounted at various angles, while ensuring sufficient and effective dispersion of lubrication fluid within the transmission chamber 60. It is noted that the passageway 66 projects from the center socket 86 (see FIG. 4).

An endless O-ring 94 retained within a continuous groove defined in the case section 36 provides a seal between the case sections 36 and 38 (see FIG. 4). A pair of alignment rods 96 and 98 (see FIG. 3) ensure proper positioning of the case sections 36 and 38 relative to one another, as well as a series of attachment screws 100 (see also FIG. 2).

Figure 2:
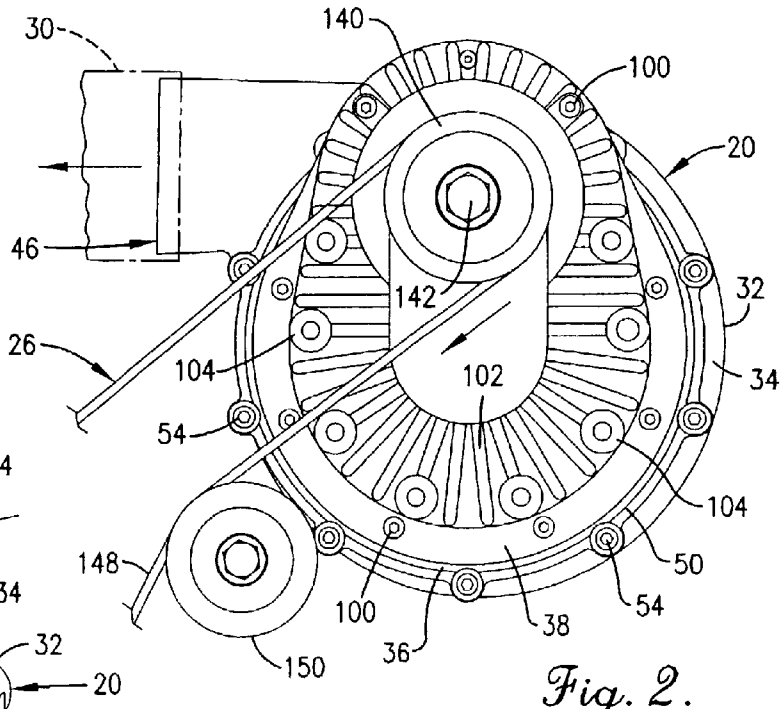
FIG. 2 is an enlarged, fragmentary front elevational view of the engine taken along line 2—2 of FIG. 1.

As particularly shown in FIG. 2, the illustrated case section 38 presents a finned outer face 102 for promoting heat exchange between the transmission chamber, particularly the lubrication fluid, and atmosphere. The outer face 102 is also provided with a plurality of mounting bosses 104, each being tapped so that a mounting bolt (not shown) may be threaded therein to fasten the supercharger 20 to a mounting bracket (also not shown) fixed to the engine 22.

In the usual manner, the supercharger 20 includes a rotatable impeller 106 located within the compressor chamber 40 (see FIG. 4). The impeller 106 is preferably machined from a billet of 7075 T-6 aircraft aluminum, although other suitable materials (e.g., cast aluminum) may be used. It is further preferred to use the impeller commercially available from the assignee of record of the invention claimed herein. However, the impeller 106 may be variously configured without departing from the spirit of the present invention. With respect to the preferred embodiment, the impeller 106, regardless of its design, induces and causes fluid to flow through the compressor chamber 40 as hereinabove described. It is particularly noted that the impeller 106 is provided with a central mounting hole 108. In addition, the impeller 106 has a circular, solid base 110 that spans and is received in the recess 48.

The impeller 106 is drivingly connected to the belt drive 26 of the engine 22 by a transmission 112 located generally in the transmission chamber 60. The transmission 112 may be variously configured but at least some component(s) thereof preferably require(s) continuous lubrication during operation.

In the preferred embodiment, the transmission 112 includes an impeller shaft 114 rotatably supported by a pair of bearing assemblies 116 and 118 press fit within respective ones of the sockets 72 and 74. In the usual manner, a wavy spring washer 120 is provided in at least one of the sockets 72 and 74. As is sometimes common because of the extremely high rotational speeds of the impeller 106, additional bearing assemblies (not shown) may be used to support the impeller shaft 114. The construction of the various bearing assemblies used in the illustrated supercharger 20 will not be described in detail, with the understanding that each illustrated assembly includes an inner race suitably fixed (e.g., press fit) to the shaft rotatably supported by the assembly, an outer race suitably fixed to the case section to which the assembly is mounted, and a ball and cage assembly retained between the races. Furthermore, the illustrated bearing assemblies are not prelubricated and require continuous lubrication during operation. However, the principles of the present invention are equally applicable to various other types of bearing assemblies (e.g., prelubricated bearing assemblies, ceramic balls, rolling bearings, tapered bearings, etc.).

The illustrated impeller shaft 114 projects through the opening 62 and into the compressor chamber 40. The mounting hole 108 of the impeller 106 receives the end of the shaft 114 therein, with the impeller 106 preferably being pressed onto the shaft 114 and retained thereon by a cap 122. It is noted that the cap 122 is secured in place by a screw 124 threaded into an axial bore 126 of the shaft 114. In the illustrated embodiment, the shaft 114 presents a cantilevered section (i.e., the portion of the shaft 114 projecting leftwardly beyond the bearing assembly 116 when viewing FIG. 4) on which the impeller 106 is mounted. However, it is entirely within the ambit of the present invention to alternatively support the impeller shaft 114 on both sides of the impeller 106. For example, a suitable alternative construction might involve lengthening the impeller shaft so that it projects beyond the impeller and providing a bearing assembly in the compressor chamber between the shaft and case.

When it is desired to remove the impeller 106 from the shaft 114, the outer case section 34 is detached from the middle case section 36 and the retaining screw 124 and cap 122 are removed. The plugs 68,69,70 are also unscrewed from their respective passageways 64,65,66. A tool may then be inserted through one or all of the passageways 68,69,70 to engage the impeller base 110 and force the impeller 106 off the end of the shaft 114. This might require a significant removal force because the impeller 106 is preferably press fit onto the shaft 114.

The impeller shaft 114 is preferably machined to present a pinion 128 located between the bearing assemblies 116 and 118. The pinion 128 intermeshes with a relatively larger gear 130 supported by an input shaft 132. The gear 130 is preferably keyed to the shaft 132, although these components may be fixedly interconnected in any other suitable manner. Similar to the impeller shaft 114, a pair of bearing assemblies 134 and 136 press fit within respective ones of the sockets 80 and 82 rotatably support the input shaft 132. Additionally, a wavy spring washer 138 is provided in the socket 82 adjacent the dividing wall 84. The input shaft 132 projects through the shaft opening 78 and beyond the outer face 102 of the case section 38. The belt drive 26 includes a driven sheave 140 keyed to the outwardly projecting portion of the input shaft 132. The driven sheave 140 is further retained on the shaft 132 by a screw 142 threaded into an axial bore 144 of the shaft 132. The illustrated belt drive 26 further includes a drive sheave 146 fixed to the crank shaft 24, a belt 148 entraining the sheaves 140 and 146, and an idler sheave 150 suitably tensioning the belt 148. Thus, rotation of the crank shaft 24 effects rotation of the impeller 106.

The pinion 128 is significantly smaller than the drive gear 130 so that the transmission provides a significant step up in rotational speed between the input shaft 132 and impeller shaft 114. For example, during regular operation of the supercharger 20, the illustrated shaft 114 and pinion 128 will reach speeds of up to 30,000 to 70,000 rpm. A suitable pinion 128 diameter is approximately 1.2 inches, with the drive gear 130 being about three times that size.

Because lubrication fluid will be dispersed throughout the transmission chamber 60 in the manner described below, seal assemblies 152 and 154 are provided at the shaft openings 68 and 78, respectively. Turning first to the impeller shaft seal assembly 152, a retaining ring 156 maintains a seal 158 against the dividing wall 76. The seal 158 is provided with a circumferential O-ring 160 that sealingly engages the case section 34. The seal 158 is formed of any suitable material, such as that available under the designation "TEFLON", and preferably provides double or redundant sealing contact with a seal ring 161 of the impeller shaft 114. On the other hand, the input shaft seal assembly 154 includes a metal case 162 press fit within the case section 38 against the dividing wall 84. The case 162 houses a rubber seal 164 that is sealingly retained between the input shaft 132 and case 162 by a spring 166. The illustrated seal assemblies 152 and 154 are preferred but shall be considered as illustrative only, and the principles of the present invention are equally applicable to a supercharger using various other types of seals.

Those ordinarily skilled in the art will appreciate that the gears 128, 130 and, in the preferred embodiment, the bearing assemblies 116,118,134,136 require lubrication during operation. The supercharger 20 is preferably self-contained such that lubrication of the transmission is provided exclusively by a lubricant contained entirely within the transmission chamber 60. The transmission chamber 60 includes a lubricant reservoir portion that is preferably located below the transmission 112. A dashed line 168 in FIG. 3 represents the top boundary of the reservoir portion of the transmission chamber 60, as well as the surface of the fluid contained within the transmission chamber 60. That is to say, the quantity of fluid within the transmission chamber 60 essentially defines the fluid reservoir portion.

A lubricant slinging disc 170 projects into the reservoir portion so as to be partly submerged in the lubricant. The illustrated disc 170 includes an outer toothed edge 172 that intermeshes with the pinion 128 so that the disc 170 is rotated by the transmission 112. Such an arrangement is disclosed in contemporaneously filed application for U.S. Pat. Ser. No. 09/668,223, filed Sep. 22, 2000, entitled CENTRIFUGAL SUPERCHARGER HAVING LUBRICATING SLINGER, which is hereby incorporated by reference herein as is necessary for a full and complete understanding of the present invention. As shown in FIG. 4, the disc 120 is suitably fixed (i.e., press fit) to a shaft 174 and positioned between a pair of bearing assemblies 176 and 178 by respective spacers 180 and 182. The bearing assemblies 176 and 178 are press fit within respective ones of the sockets 86 and 88 and thereby serve to rotatably support the shaft 174 and disc 170 within the transmission chamber 60. As with the other shaft assemblies, a wavy spring washer 184 is provided in the socket 88 adjacent the bearing assembly 178.

As noted in the incorporated application, the disc 170 creates a highly desirable lubricating mist within the transmission chamber 60. The mist ensures that the transmission components (i.e., the gears 128,130 and the bearing assemblies 116,118,134,136) are adequately lubricated without creating undesirable hydraulic separation forces.

However, the principles of the present invention are equally applicable to various other supercharger lubrication systems. That is, the present invention is preferably utilized with a self-contained supercharger having a partly filled transmission chamber, although the inventive features can be employed in a supercharger using an outside lubrication source or a supercharger having a fully filled transmission chamber. For example, it is entirely within the ambit of the present invention to lubricate the transmission with engine lubricant or a recirculating lubrication system dedicated to the supercharger. The alternative supercharger may also include wicks or jet sprayers, rather than the slinging disc 170, for directing lubricant to the transmission components. It is again noted, however, that the illustrated lubrication system is most preferred because a failure of the transmission 12 (e.g., metal fragments produced by broken gear teeth, shaft failures, etc.) do not damage the engine 20.

Those ordinarily skilled in the art will appreciate that the gear-type transmission 112 produces noise, particularly at high operation conditions. Moreover, the transmission noise is amplified by the impeller 106 to levels that are generally considered undesirable. In fact, the noise generated by the supercharger 20 can exceed the noise produced by the engine 22. It has been determined that, by dampening sound waves propagating to the impeller 106 , such amplification can be prevented or, at the very least, reduced so that transmission noise remains at a tolerable level. Particularly, it has been determined that sound waves generated by the transmission 112 can be sufficiently dampened by forming at least a portion of one or more of the transmission components fixed relative to the impeller 106 of cast iron. Most preferably, the impeller shaft 114 is formed of cast iron. The pinion 128 may alternatively or additionally be formed of cast iron. It is also entirely within the ambit of the present invention to form only a portion of the shaft 114 and/or the pinion 128 of cast iron. For example, it may be possible to form just the cantilevered section of the shaft 114 from cast iron. It is also believed that forming just the toothed periphery of the pinion 128 of cast iron provides sufficient dampening of transmission noise to prevent undesirable amplification by the impeller 106. With respect to the embodiment shown in FIGS. 1–5, the shaft 114 and gear 128 are machined from a solid unitary piece of cast iron. Although this construction is most preferred, it is not necessary.

The principles of the present invention are also equally applicable to other gear-type transmissions, as it is believed that virtually every gear-type transmission generates noise that is in turn amplified by the impeller. That is to say, the transmission need not include or comprise only spur gears. For example, the transmission may alternatively include a spiral gear(s) or helical gear(s).

Those ordinarily skilled in the art will appreciate that gear-type supercharger transmissions (i.e., a transmission formed at least partly of a gear train drivingly connected to the impeller shaft) have traditionally been formed of high strength steel. This is primarily attributable to the fact that other materials were believed to have insufficient strength and durability characteristics to withstand the extreme operating conditions of the transmission. Contrary to this common belief, it has been determined that a component(s) of the transmission can be formed of cast iron so as to reduce amplification of transmission noise by the impeller 106, without sacrificing the structural integrity of the supercharger 20. Again, in the illustrated embodiment, the shaft 114 and gear 128 are integrally formed of a single piece of cast iron. Most preferably, the shaft 114 and gear 128 are formed of a partially pearlitic ductile iron, although gray irons and other ductile irons may be used and are within the scope of the present invention. One suitable commercially available partially pearlitic ductile iron is available as Grade 80-55-06 sold under the designation "DURA-BAR" by Wells Dura-Bar of Woodstock, Illinois, a division of Wells Manufacturing Company. It will be appreciated that cast iron sold under the DURA-BAR designation is formed by a continuous cast process (i.e., the molten material is pulled through a cooling die).

Figure 5:
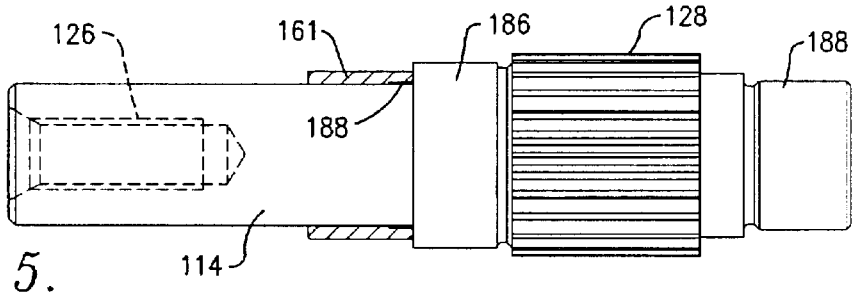
FIG. 5 is a greatly enlarged elevational view of the impeller shaft, with the seal collar thereof being shown in section.

The unitary cast iron body forming the shaft 114 and gear 128 is shown in FIG. 5. It is particularly noted that the shaft 114 includes a pair of bearing assembly journals 186 and 188 on opposite sides of the pinion 128. The inner race of each of the bearing assemblies 176 and 178 is fixed to the respective one of the journals 186 and 188, as noted hereinabove. It is also noted that the shaft-receiving opening of the seal ring 161 expands slightly at the end adjacent the bearing assembly journal 186, and this groove is represented by the numeral 188 in FIG. 5. Those ordinarily skilled in the art will appreciate that the tool used to machine the cantilevered shaft section (i.e., the section of the shaft 114 extending leftwardly beyond the journal 186 in FIG. 5) leaves a radius at the interior corner defined between the cantilevered shaft section and the journal 186. The groove 188 permits the shaft-receiving opening of the ring 161 to be otherwise snugly received on the cantilevered shaft section, while ensuring that the ring 161 can be pressed into contact with the journal 186. That is, the groove 188 ensures that the tool nose radius does not prevent the seal 161 from being pressed flush against the journal 186. Accordingly, the cantilevered section of the shaft 114 shown in FIG. 5 need not be relieved and consequently has a constant diameter along the entire length thereof. The seal ring 161 is preferably formed of the same material as the shaft 114 and pinion 128, although other suitable materials may be used.

With particular respect to the embodiment shown in FIGS. 1–5, it has also been determined that the cantilevered shaft section preferably presents a minimum diameter depending on the desired horsepower increase provided by the supercharger 20. A study has been conducted to determine the preferred minimum diameter of the cantilevered shaft section for various boost horsepower ranges.

The study involved testing of the illustrated supercharger 20 in a 1997 Ford Mustang GT having a 4.6 liter engine. The supercharger 20, with a impeller shaft having a known cantilevered shaft section diameter, was powered by the engine until the shaft failed. The horsepower increase provided by the supercharger 20 at the point of shaft failure was then calculated. The test was repeated numerous times for various shaft dimensions.

The results of these tests are summarized below in TABLE 1. The entries in the first column of the table each identify a range of horsepower increase provided by the supercharger 20. The second column is an approximate minimum diameter for the cantilevered section of the shaft 114, with the minimum diameter value being representative of a impeller shaft construction that is believed to be durable and practical and not susceptible to premature failure.

TABLE 1

| Boost Horsepower (gasoline) | Minimum Diameter of Cantilevered Shaft Section (Unrelieved) (Inches) |
|---|---|
| 150–200 | 0.268 |
| 200–250 | 0.295 |
| 250–300 | 0.316 |
| 300–350 | 0.337 |
| 350–400 | 0.354 |
| 400–450 | 0.370 |
| 450–500 | 0.386 |
| 500–550 | 0.400 |
| 550–600 | 0.410 |
| 600–650 | 0.423 |
| 650–700 | 0.434 |
| 700–750 | 0.445 |
| 750–800 | 0.455 |
| 800–850 | 0.466 |
| 850–900 | 0.475 |
| 900–950 | 0.485 |
| 1000–1050 | 0.502 |
| 1050–1100 | 0.512 |
| 1100–1150 | 0.518 |
| 1150–1200 | 0.525 |

Again, the exemplary values listed in TABLE 1 are for a supercharger 20 having the impeller 106 mounted on a cantilevered section of the shaft 114. These values would likely change in alternative supercharger configurations. For example, an impeller shaft that is rotatably supported on both sides of the impeller will probably have minimum diameters smaller than those listed in TABLE 1.

Figure 6:
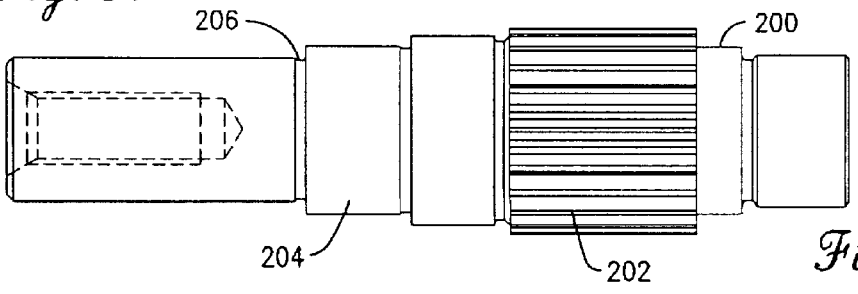
FIG. 6 is a elevational view of an alternative embodiment of the impeller shaft, wherein the alternative shaft is machined entirely from a common billet.

The principles of the present invention are also equally applicable to various other impeller shaft constructions. One suitable alternative impeller shaft 200 is shown in FIG. 6. Similar to the embodiment shown in FIGS. 1–5, the shaft 200 and pinion 202 are integrally formed of a single, solid piece of cast iron. However, the shaft 200 does not include a seal ring press fit on the cantilevered shaft section. Instead, the seal journal 204 is provided by an integral portion of the shaft 200; that is, the seal journal 204 is machined with the shaft 200 and gear 202 from the same piece of cast iron. To permit seating of the impeller (not shown) against the exposed end of the journal 204, a circumferential relief 206 is ground into the shaft 200 alongside the journal 204. The relief 206 consequently presents the narrowmost portion of the cantilevered section of the shaft 200. Those ordinarily skilled in the art will appreciate that the relief 206 is also a location that likely experiences significant stress concentration levels during operation of the supercharger. A study similar to that described above has been performed for the impeller shaft 200, and the results of this study are set forth in TABLE 2.

TABLE 2

| Boost Horsepower (gasoline) | Minimum Diameter of Cantilevered Shaft Section (Relieved) (Inches) |
|---|---|
| 150–200 | 0.300 |
| 200–250 | 0.329 |
| 250–300 | 0.354 |
| 300–350 | 0.375 |
| 350–400 | 0.396 |
| 400–450 | 0.413 |
| 450–500 | 0.431 |
| 500–550 | 0.445 |
| 550–600 | 0.461 |
| 600–650 | 0.474 |
| 650–700 | 0.485 |
| 700–750 | 0.498 |
| 750–800 | 0.509 |
| 800–850 | 0.520 |
| 850–900 | 0.531 |
| 900–950 | 0.541 |
| 1000–1050 | 0.560 |
| 1050–1100 | 0.571 |
| 1100–1150 | 0.579 |
| 1150–1200 | 0.587 |

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A compressor comprising:

a rotatable impeller; and a gear-type transmission operable to drivingly connect the impeller to a power source, said transmission including a plurality of gears and an impeller shaft that is fixed relative to a first one of the gears and supports the impeller, with at least a portion of either or both the impeller shaft and the first gear being formed of cast iron so as to dampen transmission-generated sound waves propagating to the impeller, said impeller shaft and said first gear being integrally formed of a unitary piece of cast iron.

2. The compressor as claimed in claim 1, said first gear having a pitch line velocity of at least about 12,000 feet per minute during rotation of the impeller.

3. The compressor as claimed in claim 1, said impeller shaft and said first gear being formed of ductile iron.

4. The compressor as claimed in claim 1, said transmission including an input shaft connectable to the power source, said input shaft being fixed to a second one of the gears.

5. The compressor as claimed in claim 4, said first and second gears intermeshing with one another, such that power from the input shaft is transferred directly to the impeller shaft.

6. The compressor as claimed in claim 1, said gears comprising spur gears.

7. The compressor as claimed in claim 1;

a case presenting a compressor chamber and a transmission chamber, said impeller being located in the compressor chamber and at least part of the transmission being located in the transmission chamber; and a quantity of lubrication fluid to lubricate the transmission, wherein the fluid is contained entirely within the transmission chamber.

8. The compressor as claimed in claim 1, said shaft including a cantilevered section on which the impeller is mounted, said cantilevered shaft section having a minimum diameter of at least about 0.268 inch.

9. The compressor as claimed in claim 8, said minimum diameter being between about 0.268 inch and about 0.525 inch, inclusive.

10. The compressor as claimed in claim 1, said shaft including a cantilevered section on which the impeller is mounted, said cantilevered shaft section including a relief and having a minimum diameter of at least about 0.300 inch.

11. A compressor for pressurizing a fluid, said compressor comprising:

a rotatable impeller operable to pressurize the fluid; and a gear-type transmission operable to drivingly connect the impeller to a power source, said transmission including a plurality of gears and an impeller shaft that is fixed relative to a first one of the gears and supports the impeller, with at least a portion of either or both the impeller shaft and the first gear being formed of cast iron so as to dampen transmission-generated sound waves propagating to the impeller, said first gear having a pitch line velocity of at least about 12,000 feet per minute during rotation of the impeller, said impeller shaft being formed at least in part of cast iron and including a cantilevered section on which the impeller is mounted.

12. The compressor as claimed in claim 11, said impeller shaft being formed of ductile iron.

13. The compressor as claimed in claim 11, said transmission including an input shaft connectable to the power source, said input shaft being fixed to a second one of the gears.

14. The compressor as claimed in claim 13, said first and second gears intermeshing with one another, such that power from the input shaft is transferred directly to the impeller shaft.

15. The compressor as claimed in claim 11, said gears comprising spur gears.

16. The compressor as claimed in claim 11;

a case presenting a compressor chamber and a transmission chamber, said impeller being located in the compressor chamber and at least part of the transmission being located in the transmission chamber; and a quantity of lubrication fluid to lubricate the transmission, wherein the fluid is contained entirely within the transmission chamber.

17. The compressor as claimed in claim 11, said cantilevered shaft section having a minimum diameter of at least about 0.268 inch.

18. The compressor as claimed in claim 17, said minimum diameter being between about 0.268 inch and about 0.525 inch, inclusive.

19. The compressor as claimed in claim 11, said cantilevered shaft section including a relief and having a minimum diameter of at least about 0.300 inch.

20. A compressor for pressurizing a fluid, said compressor comprising:

a rotatable impeller operable to pressurize the fluid; and a gear-type transmission operable to drivingly connect the impeller to a power source, said transmission including a plurality of gears and an impeller shaft that is fixed relative to a first one of the gears and supports the impeller, with at least a portion of either or both the impeller shaft and the first gear being formed of cast iron so as to dampen transmission-generated sound waves propagating to the impeller, said impeller shaft being formed at least in part of cast iron and including a cantilevered section on which the impeller is mounted.

21. The compressor as claimed in claim 20, said impeller shaft being formed of ductile iron.

22. The compressor as claimed in claim 20, said transmission including an input shaft connectable to the power source, said input shaft being fixed to a second one of the gears.

23. The compressor as claimed in claim 22, said first and second gears intermeshing with one another, such that power from the input shaft is transferred directly to the impeller shaft.

24. The compressor as claimed in claim 20, said gears comprising spur gears.

25. The compressor as claimed in claim 20, a case presenting a compressor chamber and a transmission chamber, said impeller being located in the compressor chamber and at least part of the transmission being located in the transmission chamber; and a quantity of lubrication fluid to lubricate the transmission, wherein the fluid is contained entirely within the transmission chamber.

26. The compressor as claimed in claim 20, said cantilevered shaft section having a minimum diameter of at least about 0.268 inch.

27. The compressor as claimed in claim 26, said minimum diameter being between about 0.268 inch and about 0.525 inch, inclusive.

28. The compressor as claimed in claim 20, said cantilevered shaft section including a relief and having a minimum diameter of at least about 0.300 inch.

* * * * *